United States Patent [19]

Guglieetti et al.

[11] Patent Number: 5,072,016

[45] Date of Patent: Dec. 10, 1991

[54] MIXTURES OF FLUORESCENT WHITENING AGENTS

[75] Inventors: Leonardo Guglieetti, Bottmingen; Hans R. Meyer, Binningen, both of Switzerland; Dieter Reinehr, Kandern, Fed. Rep. of Germany; Kurt Weber, Basel, Switzerland

[73] Assignee: Ciba-Geigy Corporation, Ardsley, N.Y.

[21] Appl. No.: 581,244

[22] Filed: Sep. 7, 1990

Related U.S. Application Data

[63] Continuation of Ser. No. 381,437, Jul. 18, 1989, abandoned, which is a continuation of Ser. No. 148,453, Jan. 25, 1988, Pat. No. 4,867,906.

[30] Foreign Application Priority Data

Jan. 29, 1987 [CH] Switzerland ..... 306/87

[51] Int. Cl.[5] ..... C07C 255/00

[52] U.S. Cl. ..... 558/373; 252/301.21; 252/301.22; 558/411

[58] Field of Search ..... 252/301.21, 301.22; 558/373, 411

[56] References Cited

U.S. PATENT DOCUMENTS

| | | | |
|---|---|---|---|
| 4,330,427 | 5/1982 | Martini et al. | 252/301.24 |
| 4,336,155 | 6/1982 | Martini et al. | 252/301.21 |
| 4,380,514 | 4/1983 | Seybold | 252/301.21 |
| 4,464,284 | 8/1984 | Seybold | 252/301.21 |
| 4,508,784 | 4/1985 | Guglielmetti | 252/301.21 |
| 4,778,622 | 10/1988 | Guglielmetti et al. | 252/301.21 |
| 4,778,623 | 10/1988 | Guglielmetti et al. | 252/301.21 |
| 4,867,906 | 9/1989 | Guglielmetti et al. | 252/301.21 |
| 4,891,153 | 1/1990 | Guglielmetti et al. | 252/301.21 |

FOREIGN PATENT DOCUMENTS 3313332 10/1984 Fed. Rep. of Germany .

*Primary Examiner*—John Niebling
*Assistant Examiner*—Steven P. Marquis
*Attorney, Agent, or Firm*—George R. Dohmann; Edward McC. Roberts

[57] ABSTRACT

Mixtures of fluorescent whitening agents consisting of 51 to 99% by weight of 1-(4-cyanostyryl)-4-(3'-styryl)-benzene, 49 to 1% by weight of 1-(4-cyanostyryl)-4-(2'-cyanostyryl)benzene and 0.5 to 5% by weight of 1,4-bis(cyanostyryl)benzene, a process for the preparation of said mixtures by condensing terephthalaldehyde with a 4-dialkylphosphonomethylbenzonitrile to 4-cyano-4'-formylstilbene, which is further condensed, either direct or after isolation, with a 3- and 2-dialkylphosphonomethylbenzonitrile, the use of these mixtures for whitening polyester fibres, and compositions containing said mixtures for whitening polyester fibres.

3 Claims, No Drawings

MIXTURES OF FLUORESCENT WHITENING AGENTS

This application is a continuation, of application Ser. No. 381,437, filed 7/18/89, now abandoned, which is a continuation of application Ser. No. 148,453 filed on Jan. 25, 1988 now U.S. Pat. No. 4,867,906.

Fluorescent whitening agents are often used as mixtures of two or more different types. The reason is that such mixtures exhibit a synergistic effect, as the degree of whiteness of the mixture is greater than that of the same amount of each of the individual components. Mixtures of fluorescent whitening agents consisting of 51 to 99% by weight of an unsymmetrically substituted 1,4-bis(styryl)benzene and 49 to 1% by weight of a symmetrically substituted 1,4-bis(styryl)benzene have already been disclosed in European patent application EP-A 30917. Cyano and/or an esterified carboxyl group are named as substituents.

The present invention relates to mixtures of fluorescent whitening agents having enhanced properties and consisting of 51 to 99% by weight of a compound of formula

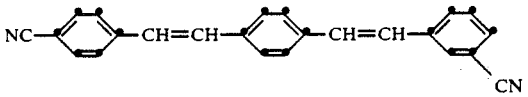

(1)

49 to 1% by weight of a compound of formula

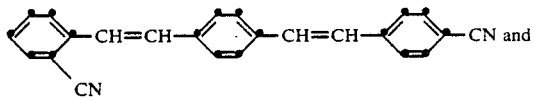

(2)

and 0.5 to 5% by weight of a compound of formula

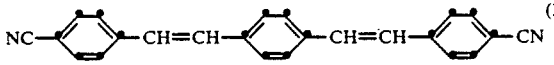

(3)

The preferred ratio is 75 to 85% by weight of the compound of formula (1) to 25 to 15% by weight of the compound of formula (2) and 1 to 3% by weight of the compound of formula (3).

The mixtures of this invention are prepared by condensing terephthalaldehyde with a 4-dialkylphosphonomethylbenzonitrile and further condensing the resultant 4-cyano-4-formylstilbene, either direct or after isolation thereof, with a 3-dialkylphosphonomethylbenzonitrile and 2-dialkylphosphonomethylbenzonitrile. To isolate the intermediate, the reaction of terephthalaldehyde with a 4-dialkylphosphonomethylbenzonitrile is carried out in the presence of an alkali metal hydroxide and water, and the precipitated 4-cyano-4-formylstilbene is isolated by filtration. The alkyl moiety is $C_1$-$C_4$alkyl, preferably methyl or ethyl.

The isolation of the 4-cyano-4'-formylstilbene can be effected in good yield and purity by condensing terephthalaldehyde with a 4-dialkylphosphonomethylbenzonitrile by using an aqueous alkali metal hydroxide, e.g. sodium hydroxide or, preferably, potassium hydroxide, as proton acceptor. This result is surprising, as aromatic aldehydes are known to undergo Cannizzaro reactions with aqueous alkali metal hydroxides to form carboxylic acids and alcohols. The presence of water makes the reaction particularly selective with respect to the monocondensation to 4-cyano-4'-formylstilbene by substantially preventing the further condensation to the symmetrical di(cyanostyryl)benzene, thus affording an advantage over the alkali metal alcoholates normally used. The additional use of a lower aliphatic alcohol containing 1 to 3 carbon atoms, especially methanol, further facilitates the process. It is not necessary to use an excess of terephthalaldehyde, i.e. approximately molar amounts of terephthalaldehyde and phosphonate are used. The reaction temperature is kept in the range from 0° to 30° C., and the amount of alkali is from 1 to 2 moles per mole of terephthalaldehyde. The water content of the alkali metal hydroxide employed varies within a wide range, preferably from 1 to 80%.

Further objects of the present invention are the use of the mixtures of the three compounds of formulae (1) to (3) for whitening polyester fibres, and also compositions for whitening polyester fibres, said compositions containing a mixture of 51 to 99% by weight of a compound of formula

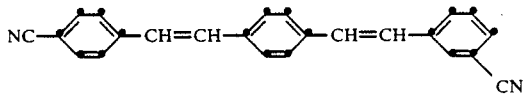

(1)

49 to 1% by weight of a compound of formula

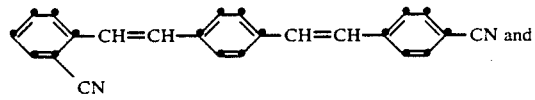

(2)

and 0.5 to 5% by weight of a compound of formula

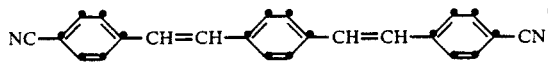

(3)

The preferred ratio is 75 to 85% by weight of the compound of formula (1) to 25 to 15% by weight of the compound of formula (2) and 1 to 3% by weight of the compound of formula (3).

As is customary with mixtures of fluorescent whitening agents, the individual components can be processed to the commercial form by dispersing them in a liquid medium. This can be done by dispersing the individual components and then combining the dispersions so obtained. However, it is also possible to mix the individual components together in substance and then to disperse them jointly. This dispersing operation is carried out in conventional manner in ball mills, colloid mills, bead mills or the like. The mixtures of this invention and the compositions containing them are admirably suitable for whitening textile material made from linear polyesters. However, these mixtures and compositions can also be used for whitening blends that contain linear polyesters.

The mixtures of this invention are applied by the methods normally employed for the application of fluorescent whitening agents, for example by the exhaust dyeing process in dyeing machines or by pad-thermofixation. The treatment is conveniently effected in an aqueous medium in which the compounds are present in finely particulate form as suspensions, microdispersions or, as the case may be, solutions. If appropriate, dispersants, stabilisers, wetting agents and other assistants can be added during the treatment. The treatment is normally carried out in the temperature range from about 20° to 140° C., for example at the boiling temperature of the bath or in the proximity thereof.

In the following Examples, w/v denotes weight by volume and HPLC stands for high performance liquid chromatography.

EXAMPLE

With stirring, 140 g of powdered potassium hydroxide (water content: 12%) are dissolved in 1600 ml of methanol, whereupon the temperature rises from 20° C. to about 45° C. The slightly turbid solution so obtained is cooled to 20° C. and 268 g of terephthaldehyde are added at this temperature over 30 minutes. To the resultant clear, yellow solution is then added a solution of 506.5 g of 4-diethylphosphonomethylbenzonitrile in 400 ml of methanol at 20°-25° C. over 1 hour and 15 minutes, whereupon crystals of the reaction product precipitate after about 10 to 15 minutes. The resultant yellow, slurry-like suspension is stirred first for 2 hours at 20°-25° C. and then for a further 2 hours at 40° C. The reaction mixture is then cooled to 20° C. and diluted at this temperature with 600 ml of methanol. The suspension so obtained is filtered with suction and the filter cake is washed in portions with 1300 ml of methanol. The moist filter cake is then suspended, with stirring, in 1440 ml of dimethylformamide and to this suspension are added 383 g of 3-diethylphosphonomethylbenzonitrile and 96 g of 2-diethylphosphonomethylbenzonitrile. The dense, yellow reaction mixture is subsequently warmed to 40° C. and 357 g of a 30% solution of sodium methylate in methanol are added at 40°-45° C. over 40 minutes. The resultant yellow suspension is stirred for 4 hours at 42° C., then cooled to 20° C., diluted with 1440 ml of methanol, neutralised with 22 ml of acetic acid and filtered with suction. The filter cake is thoroughly washed in portions with 1800 ml of methanol (6×300 ml) and vacuum dried at 100° C., affording 537 g of a mixture consisting of 78% of 1-(4-cyanostyryl)-4-(3'-cyanostyryl)benzene, 20% of 1-(4-cyanostyryl)-4-(2'-cyanostyryl)benzene and 2% of 1,4-bis(4-cyanostyryl)-benzene.

What is claimed is:

1. A process for the preparation of a mixture of fluorescent whitening agents consisting of 51 to 98.5% by weight of a compound of the formula

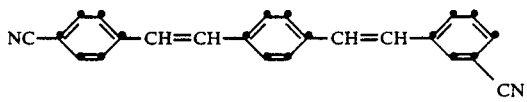

(1)

48.5 to 1% by weight of a compound of formula

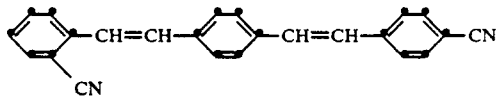

(2)

and 0.5 to 5% by weight of a compound of formula

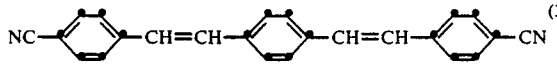

(3)

which comprises condensing, in the presence of aqueous alkali, approximately equimolar amounts of terephthaldehyde and a 4-dialkyl-phosphonomethylbenzonitrile and further condensing the 4-cyano-4'-formylstilbene obtained as intermediate, either direct or after isolation thereof, with a 3-dialkylphosphonomethylbenzonitrile and a 2-dialkylphosphonomethylbenzonitrile.

2. A process of claim 1 wherein the condensation is carried out in the presence of a $C_1$-$C_3$ aliphatic alcohol.

3. A process according to claim 1 for isolating the intermediate, which comprises carrying out the reaction of terephthalaldehyde with a 4-dialkylphosphonomethylbenzonitrile in the presence of an alkali metal hydroxide and water, and isolating the precipitated 4-cyano-4'-formylstilbene.

* * * * *